US005285987A

United States Patent [19]

Gonzalez

[11] Patent Number: 5,285,987

[45] Date of Patent: Feb. 15, 1994

[54] PEDESTAL DISPLAY SYSTEM

[76] Inventor: Carlos M. Gonzalez, 3924 Tedrich Blvd., Fairfax, Va. 22031

[21] Appl. No.: 926,028

[22] Filed: Aug. 7, 1992

[51] Int. Cl.[5] ..... A47G 7/04

[52] U.S. Cl. ..... 248/27.8; 248/159; 403/383

[58] Field of Search ..... 248/159, 431, 27.8, 248/150, 165; 403/383, 345, 375; 211/133

[56] References Cited

U.S. PATENT DOCUMENTS 164,420 6/1875 Brandeis ..... 248/159
962,185 6/1910 White ..... 248/159
1,781,203 11/1930 Teleki ..... 248/159 X
3,256,031 6/1966 Fillweber ..... 403/375
5,178,286 1/1993 Allison, III ..... 248/159 X

*Primary Examiner*—Richard K. Seidel
*Assistant Examiner*—Kenneth E. Peterson

[57] ABSTRACT

The present invention is generally related to a device for supporting objects that are being displayed. More particularly concerned with a system of interconnected pedestal displays The present invention permits the designer of pedestal displays the flexibility of easily interconnecting elements to obtain desired pedestal heights. The pedestal system also allows the selection of different support tops.

6 Claims, 14 Drawing Sheets

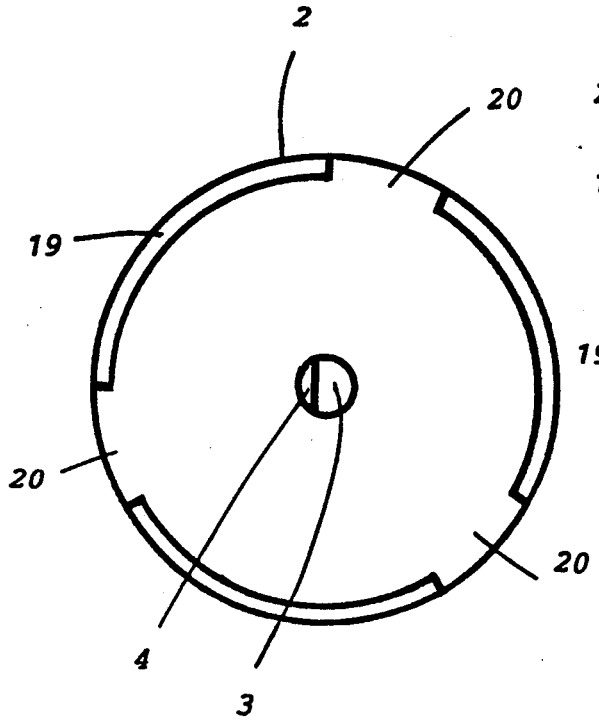
Fig. 4A
Fig. 4D
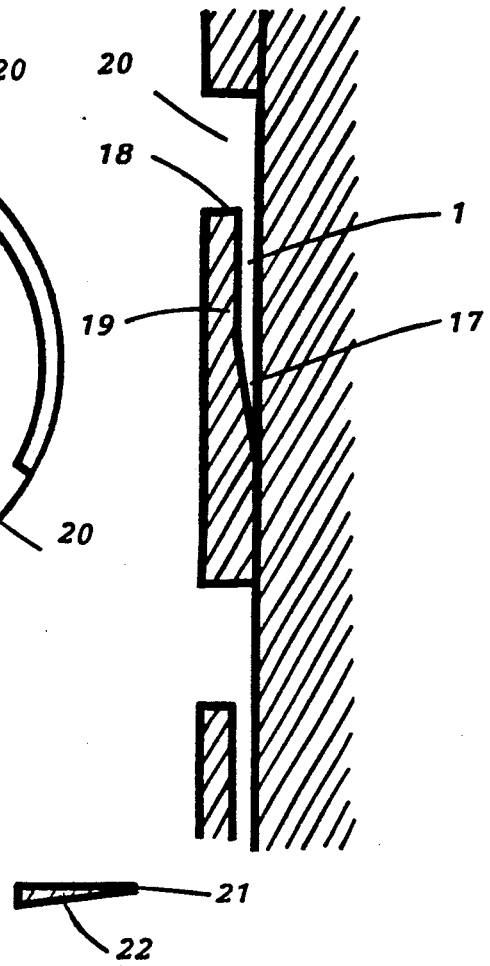
Fig. 4C
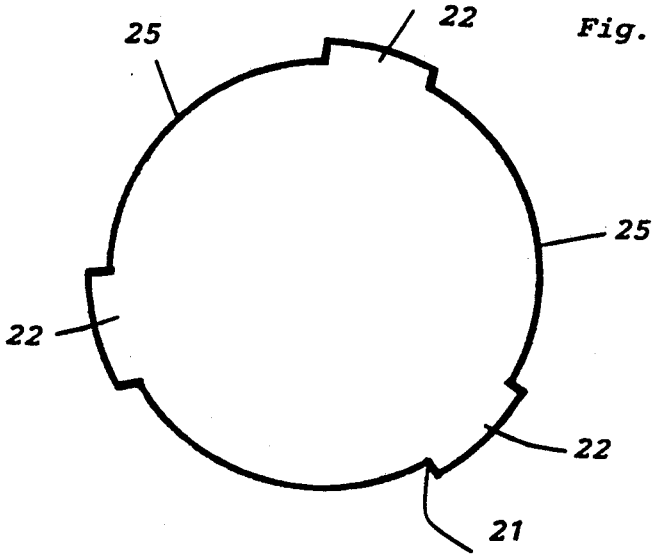
Fig. 4B

PEDESTAL DISPLAY SYSTEM

BACKGROUND OF THE INVENTION

At the present time florist, bakers and decorators are constrained by the lack of flexibility in the way they have to set up their displays. Florists for example, when designing a center piece floral arrangement have to either pick the pedestal firs (the floral arrangement is displayed on top of the pedestal) and work around the height given by the pedestal, or design their arrangement and then hope to find a pedestal that will fit the height needed for their arrangement. Unfortunately, the pedestal they use on one occasion will not necessarily be the best option for the next occasion.

Decorators like to work with sets of pedestals of different heights. In order to do their work without restricting their creativity, they will need to have at hand a good set of pedestals of different highs. Just to find the right pedestals becomes a very expensive and laborious task.

To overcome these shortcomings of existing options, the present invention is developed to produce an effective means to display objects requiring pedestals. The invention described here will give designers the option of choosing instantaneously at which height they need to have the pedestal for their display. Since a pedestal display is formed by assembling removable elements into a single unit or system of units. A pedestal can be later reused for another display at a different height, or used as a part of a more elaborate center piece.

The invention described here provides designers with the option of connecting pedestals when a larger structure is needed without restricting their creativity, at the same time offering cost-effective materials.

SUMMARY OF THE INVENTION

The present invention is a system to display objects using pedestal bases. The main body of the pedestal system is the pedestal base which provides height and stability to the object that is put on top of the pedestal base to be displayed.

A pedestal display system is formed by sets of one removable top support to display objects, zero or more removable extensions to make the display taller, zero or more removable connectors to connect to another pedestal displays, and by one pedestal base with or without a removable weight base.

The pedestal base can be attached with a variety of top support receptacles depending on the need of the display designer. For example a flat top platform can be used when the display needs to start with a flat base (like a cake for a baker). Another receptacle like in the shape of a dinner plate could be used by a florist to support a floral arrangement which is designed by using a bubble ball. A cylindrical top may be used when candles on pedestals are needed.

To obtain different heights in pedestals, all that is needed is the interconnection of different removable extensions. For example, if the pedestal base is 12". A set of 2" and 3" removable extensions can give the designer a selection of heights starting at 14" to 38" or more in increments of one inch. This is a flexibility that now designers do not have, and will appreciate very much.

When a display pedestal has too much height or too heavy at the top, a removable weight base can be attached to the pedestal base to provide extra stability and avoid tilting.

The designer can create a pedestal system by creating different pedestal displays (by using different tops and/or different heights) and interconnecting them.

The assembling of the different elements of a pedestal system is done without any tools. All the parts interconnect with each other by insertion and a twist that is done manually.

BRIEF DESCRIPTION OF THE DRAWINGS

Other objects and advantages of the invention will become more apparent from the specification taken in conjunction with the accompanying drawings, in which:

FIG. 4A is a plain view of the bottom of the pedestal base, FIG. 4B is a plain view of the removable weight base, FIG. 4C is a cross sections of the removable weight base latch and FIG. 4D is a horizontal cut around the pedestal base, showing the constructional structure thereof.

DETAILED DESCRIPTION OF THE INVENTION

Figure 1:
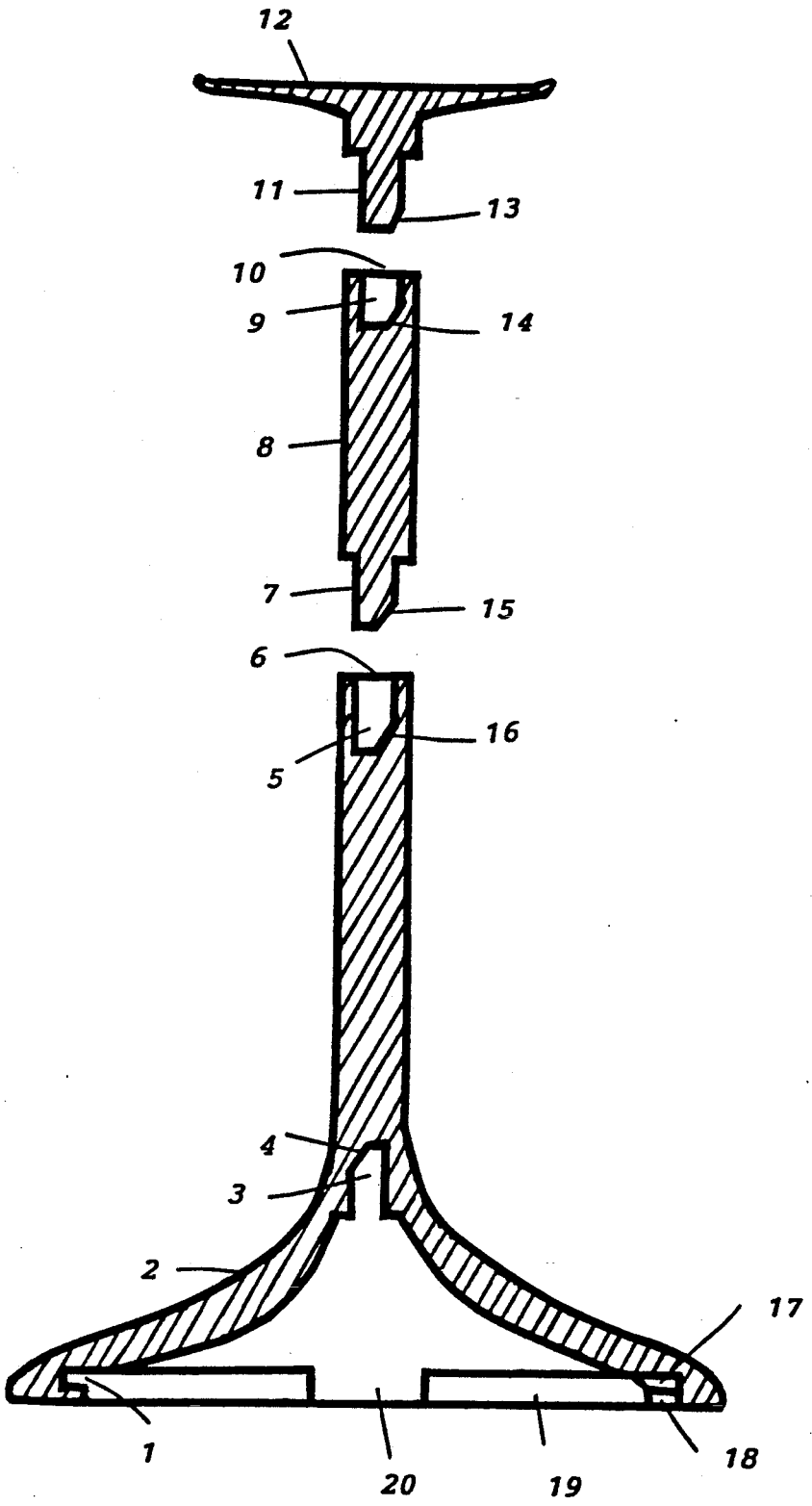
FIG. 1 is a cross section of the pedestal base, a removable extension connector and a removable top support, showing the constructional structure of each piece.
Figure 2:
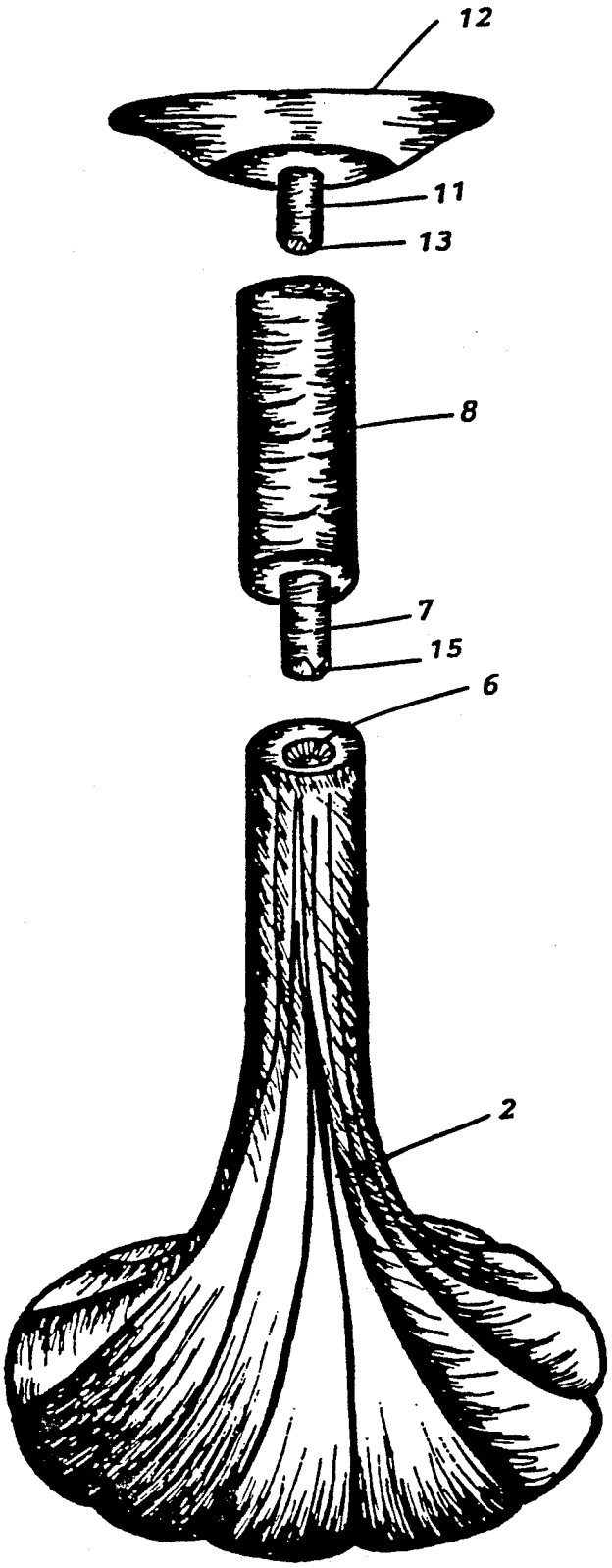
FIG. 2 is a perspective view of the pedestal base, a removable extension connector and a removable top support. Showing how together can become a pedestal display.
Figure 3:
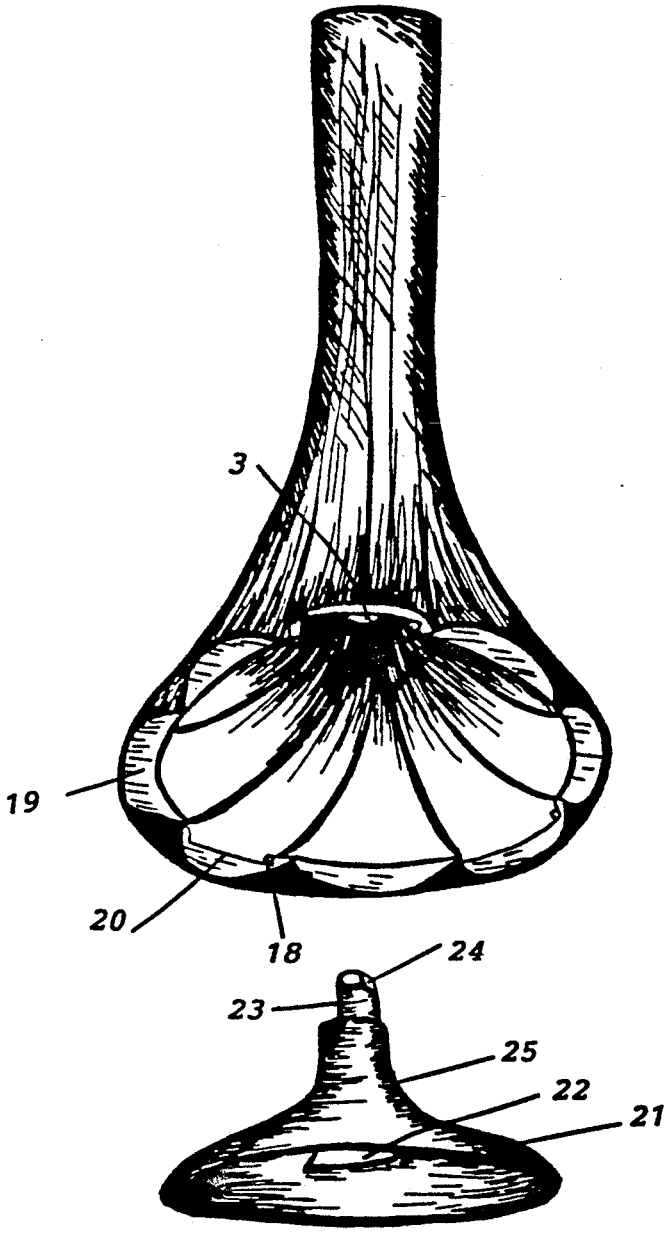
FIG. 3 is a perspective view of a pedestal base, and a removable weight base. Showing how to attach a removable weight base to a pedestal base to provide support for the whole structure.
Figure 5B:
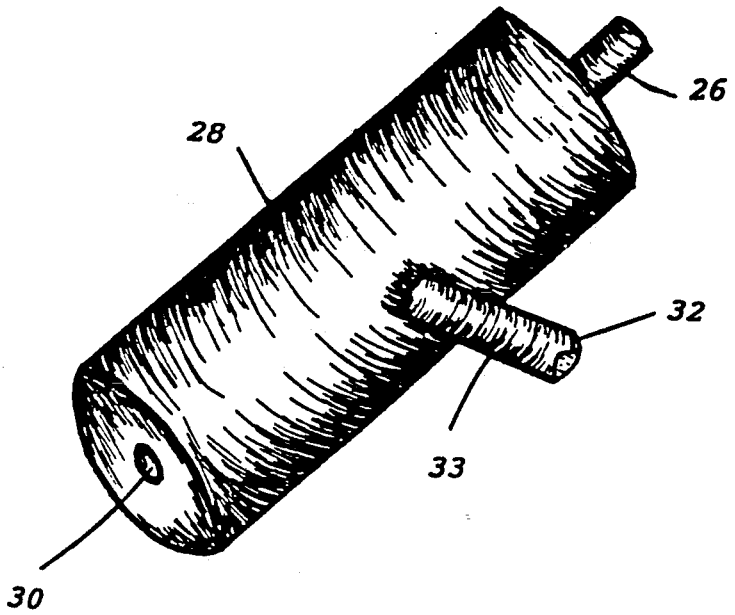
FIGS. 5A and 5B are a cross section and a perspective of a male-female removable extension connector respectively.
Figure 7B:
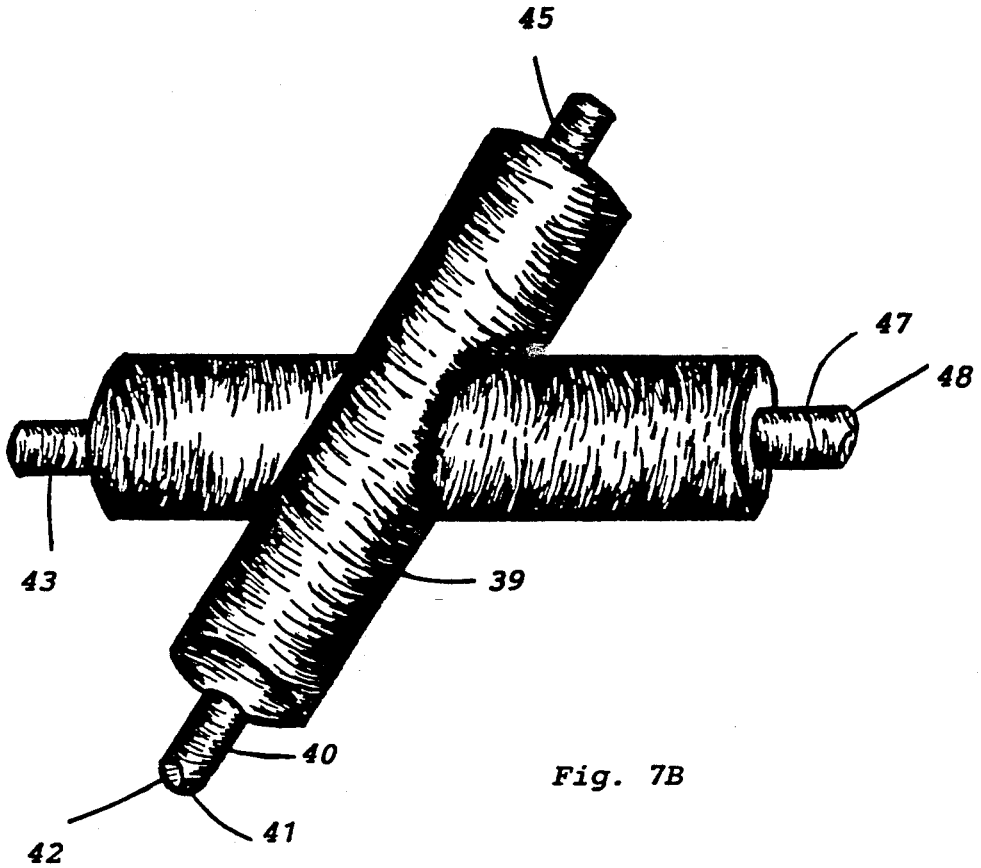
FIGS. 7A and 7B are a cross section and a perspective of a 4-male removable base to base connector respectively.

A pedestal display system is formed by sets of one removable top support (like 12 in FIG. 1 and FIG. 2, or 71 in FIG. 11B, or 81 in FIG. 12B), zero or more removable extensions to make the display taller ( like 8 in FIG. 1 and FIG. 2, or 58 in FIG. 9B), zero or more removable connectors to connect to another pedestal displays (like 28 in FIG. 5B, or 39 in FIG. 7B), by zero or more removable base to base connectors to connect to another pedestal displays (like 39 in FIG. 7B and 49 in FIG. 8B, Or 58 in FIG. 9B), by one pedestal base like 2 in FIG. 1 and FIG. 2), and with or without a removable weight base (like 25 in FIG. 3).

Referring to the drawing in FIG. 1, the pedestal base has an orifice 1 which makes a hallow guide 19 that goes around the base except in three sections where there is an opening 20. The pedestal base 2 has orifice 3 which is a female connector used to connect weight bases 25 (in FIG. 3). Orifice 3 has a slanted face inward 4 to make the connectors fit in only one way and avoid turning. The pedestal base 2 has orifice 5 which is a female connector that is accessed by inserting a male connector through orifice 6 which is in the top surface of the base and parallel to the pedestal bottom.

Extension connector 8 is composed of a male connector 7 and a slanted cut face 15 on one side of the connector, and on the opposite side a female connector 9 with an slanted inward face 14 which is accessed through orifice 10. Extension connector 8 could be attached to the base pedestal by inserting male connector 7 through orifice 6 into female connector 5, and rotating 8 until face 15 matches face 16.

A top support like 12 is composed of a flat surface on one side of the support, and on the opposite side a male connector 11 with a slanted cut face 13. The top support can be attached to any extension connector or directly to the pedestal base through male connector 11 inserted into a female connector like 9 or 5.

FIG. 2 shows a perspective view of a pedestal display with a top base 12 with an extension 8 and pedestal base 2. The pedestal display can be assembled by attaching extension 8 to pedestal base 2 by inserting male connector 7 into orifice 6 and rotating 8 until there is a lock. Then attach top by inserting male connector 11 into extension 8 through orifice 10 (shown in FIG. 1), and rotating 12 until locks.

If we invert FIG. 2 and let the top support now be the one being on the bottom, that is the flat surface of 12 will be facing the floor, and the bottom of the base pedestal 2 will be facing the top. This new pedestal provides now a useful shallow receptacle (with the space that is usually used by the weight base as shown in FIG. 3) at the top where a florist or decorator can use for their display. Since it is shallow, it will hold water, marbles, foam, soil or any other material used by decorators when handling receptacles.

If more height is needed for the pedestal display, more than one extension connector can be used. To add another extension to the pedestal display like the one in FIG. 2 one could attach another extension connector between top support 12 and existent extension connector 8. This is done by attaching top support 12 to a new extension connector (like 8, could be of the same type or of different height) by inserting male connector 11 into female connector 9 (of new extension), and rotating until lock. Then insert male connector 7 (of new extension) to female connector 5 of the old extension, and turn until lock. Then attach old extension connector 8 to base 12 as explained in the previous paragraph.

In general all connections between elements of a pedestal display will be done by means of the male-female connectors (like 7-5 or 11-9), and then rotating the elements until their slanted faces match (like 13-14 or 15-16). The only case of special locking mechanism is the attachment of a weight base to a pedestal base. The purpose of the weight base being attached to the pedestal base is to provide more support and avoid tilting to the base when higher displays are assembled or heavier elements are being put on the top support. The locking mechanism is explained in the following paragraph.

In FIG. 3 weight base 25 may be attached to pedestal base 2 by inserting male connector 23 from the weight base into female connector 3 of the pedestal base, at the same time the 3 latches 22 (see FIGS. 4A through 4D) will each go through spaces 20 in the base until the beginning of latch 22 is on top of the beginning of guide 19 which is pointed with numeral 18. Then the weight base will be rotated clockwise and latch 22 will go through orifice 1 (in FIG. 4D) until end of latch 21 reaches end of guide 17 (see FIG. 4D) and locks tight. At the same time slanted face 24 will be aligned with face 4 (in FIG. 4A).

Figure 5A:
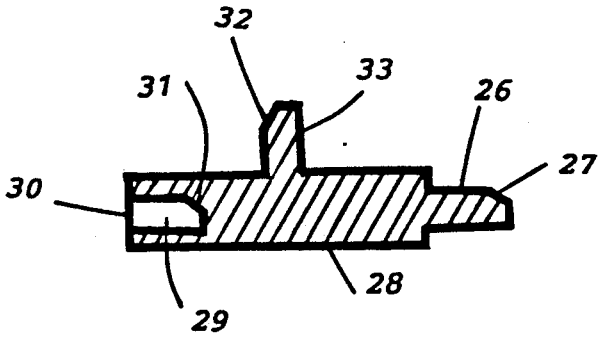
Figure 6B:
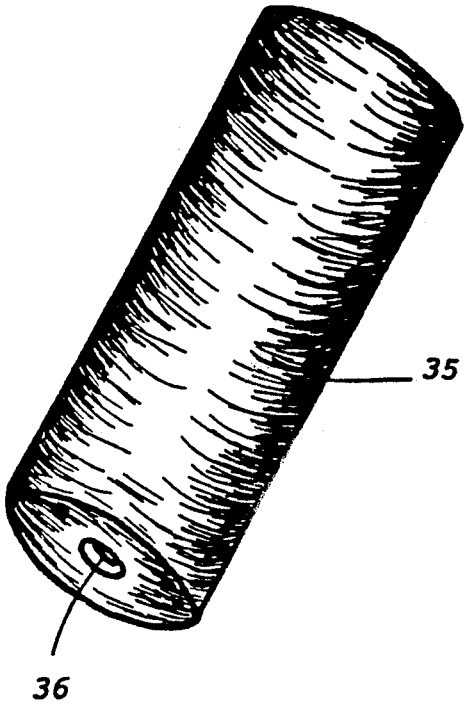
FIGS. 6A and 6B are a cross section and a perspective of a female-female removable extension connector respectively.
Figure 6A:
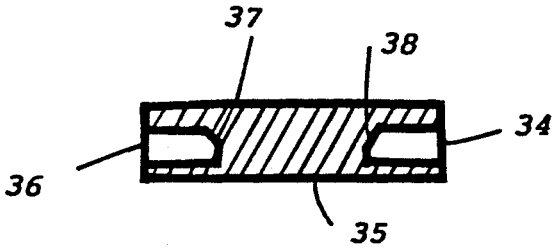

To build a pedestal display using more than one pedestal base one has to connect the bases. One way to do this is by using extension connector 28 in FIGS. 5A and 5B. which could be attached to a pedestal base by inserting male connector 26 into the female connector of the pedestal base (5 in FIG. 1) and then locking the pieces (rotating the connector until face 27 is on top of face 16 of the base). Female connector 29 will be used to build the first pedestal display with the desired height and top support. The male connector 33 is used to connect to another pedestal display. The other pedestal could be assembled as the previously described here. Then we have two pedestal displays each with male connector 33 disconnected. To close the connection we could use the female-female base to base connector 35 in FIG. 6B. Thus, if we insert the male 33 of the first pedestal into the female connector through orifice 36 and rotate the connector 35 until is locked (face 32 of the male should be touching face 37 of the female), then insert male connector 33 of the remaining pedestal base through orifice 34 and the two pedestals are now connected.

Figure 7A:
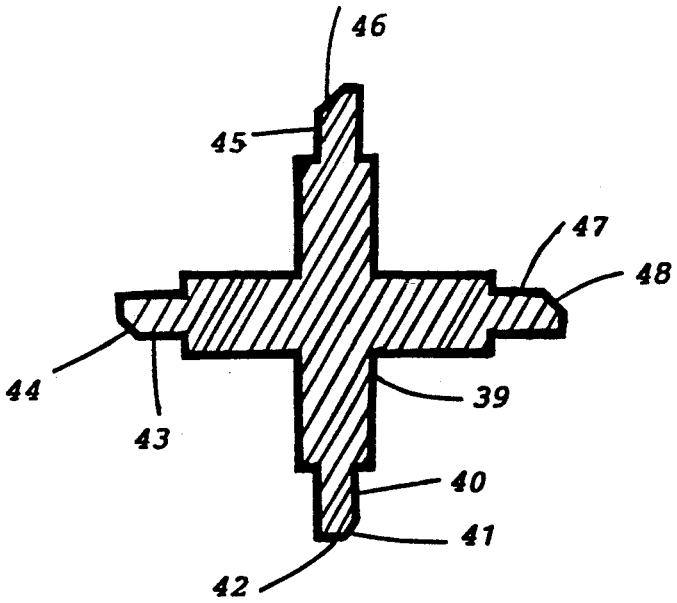

To build a pedestal system with four pedestal bases attached by a connection with the shape of a cross, we can use base to base connector 39 in FIG. 7A. Each of the male connectors (40,43,45, and 47) will be connected to female type connector like 35 in FIG. 6B. Then, each female connector will be attached to a connector like 28 in FIG. 5B which can be attached to a pedestal base as explained in the previous paragraph.

Figure 8B:
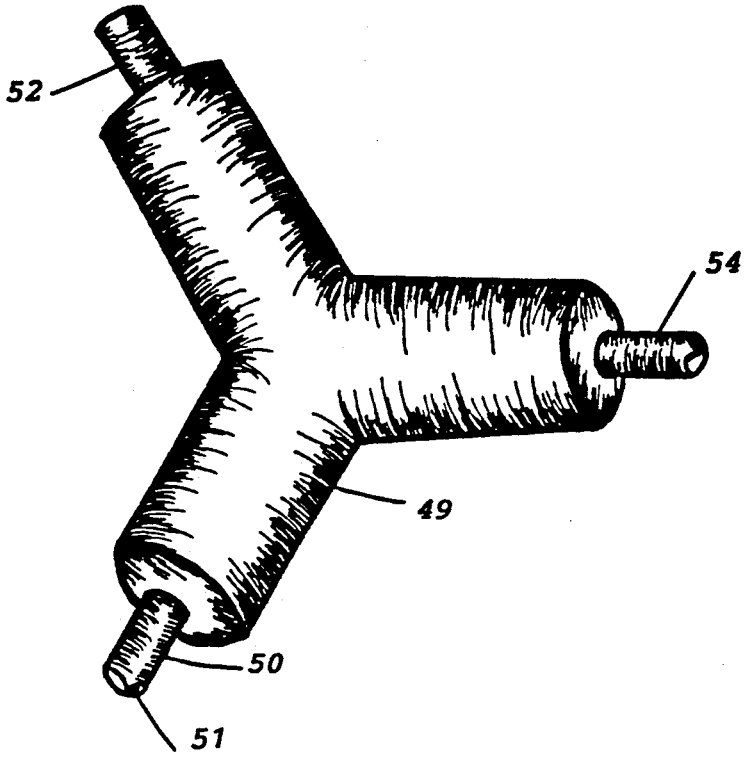
FIGS. 8A and 8B are a cross section and a perspective of a three way male removable base to base connector respectively.
Figure 8A:
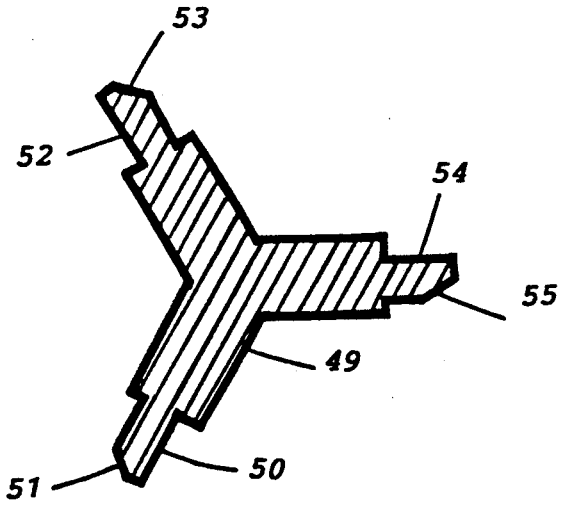

A pedestal system with three pedestal bases could be built by using connector 49 in FIG. 8B, using the same technique to make the connections as for the cross connection explained before.

Figure 9B:
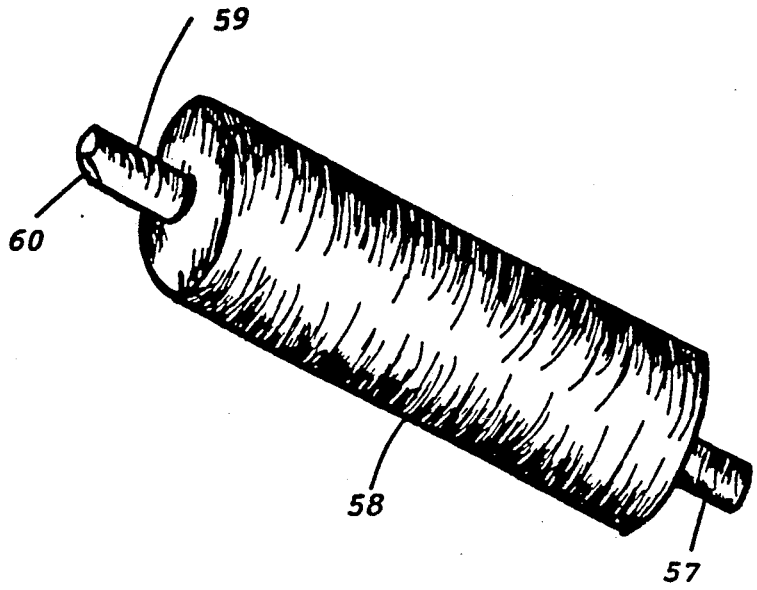
FIGS. 9A and 9B are a cross section and a perspective of a male-male removable extension or base to base connector respectively.
Figure 9A:
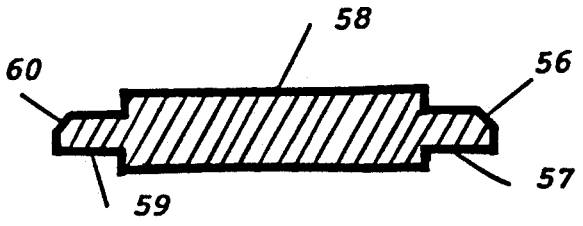
Figure 10B:
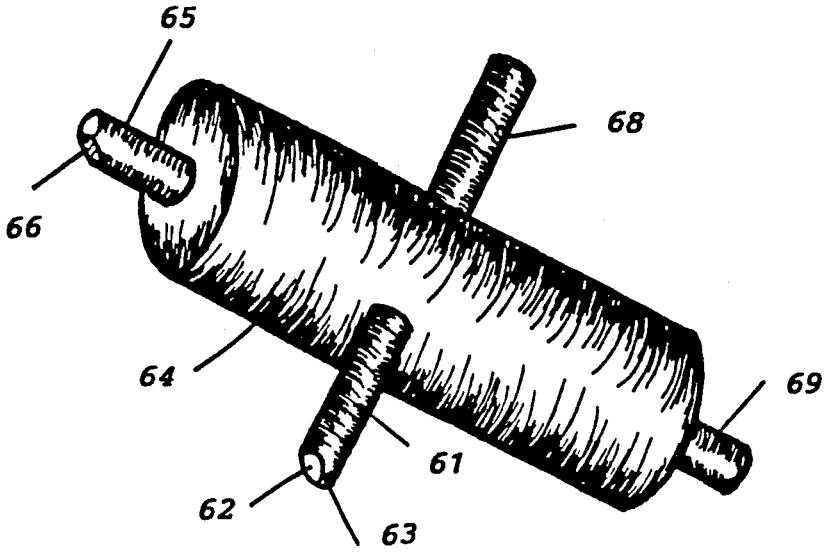
FIGS. 10A and 10B are a cross section and perspective of a 4-male removable extension or base to base connector respectively.
Figure 10A:
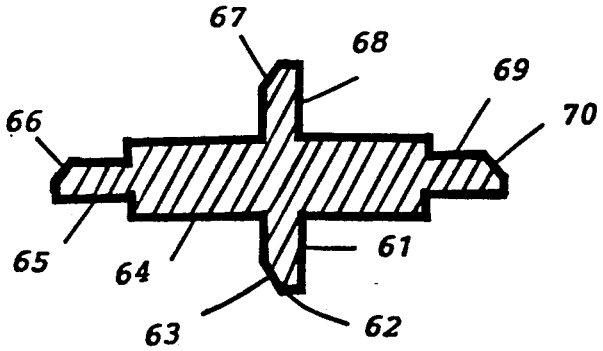

Connectors 58 in FIG. 9B, and 64 in FIG. 10B can be used to build more intricate and elaborate pedestal systems. The examples given in this description are only one of the ways of doing a particular pedestal, but a user has many more options on how to build the pedestal display for their particular need.

Figure 11C:
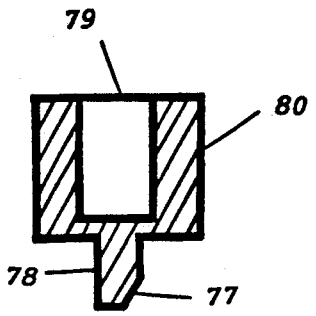
FIGS. 11C and 11D are a cross section and perspective of a removable cylindrical reduction holder respectively.
Figure 11A:
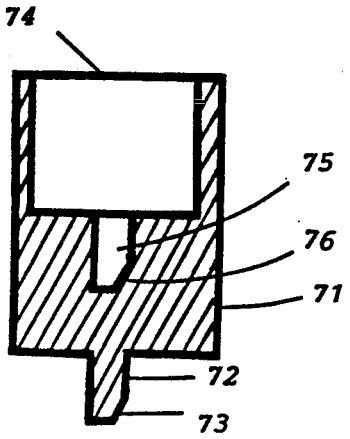
FIGS. 11A and 11B are a cross section and perspective of a removable cylindrical individual top support respectively.
Figure 11B:
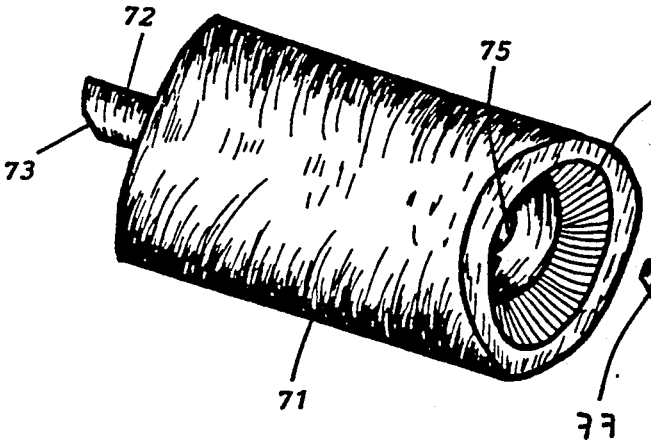
Figure 11D:
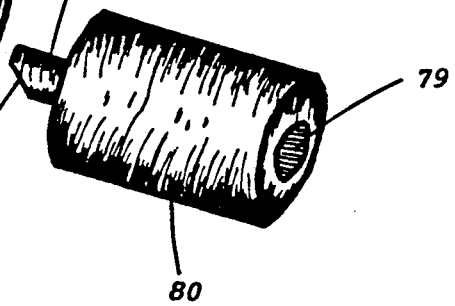
Figure 12A:
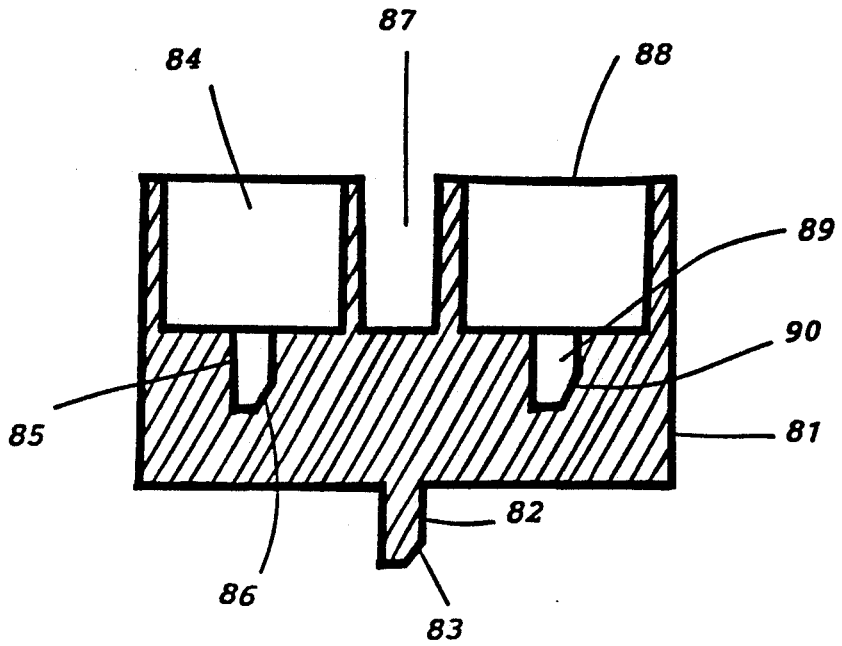
FIGS. 12A and 12B are a cross section and perspective of a removable cylindrical dual top support respectively.
Figure 12B:
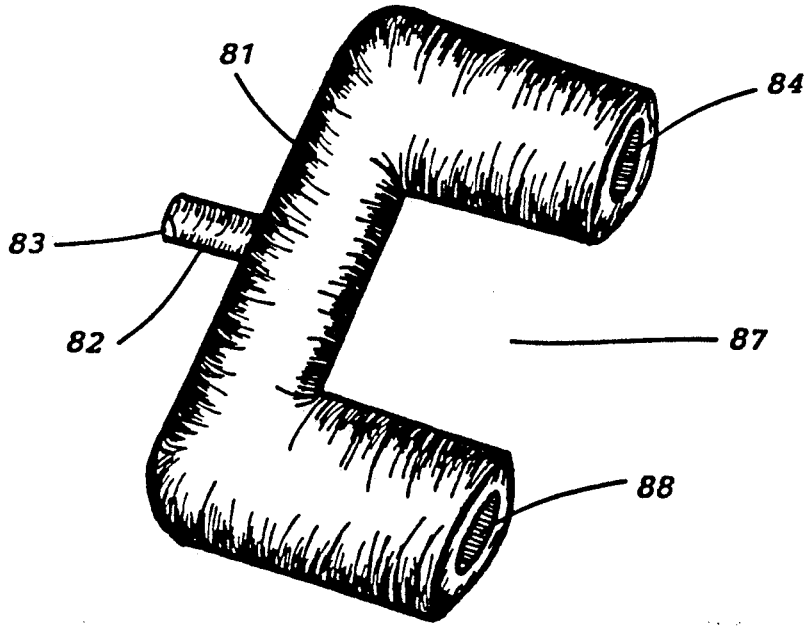
Figure 13B:
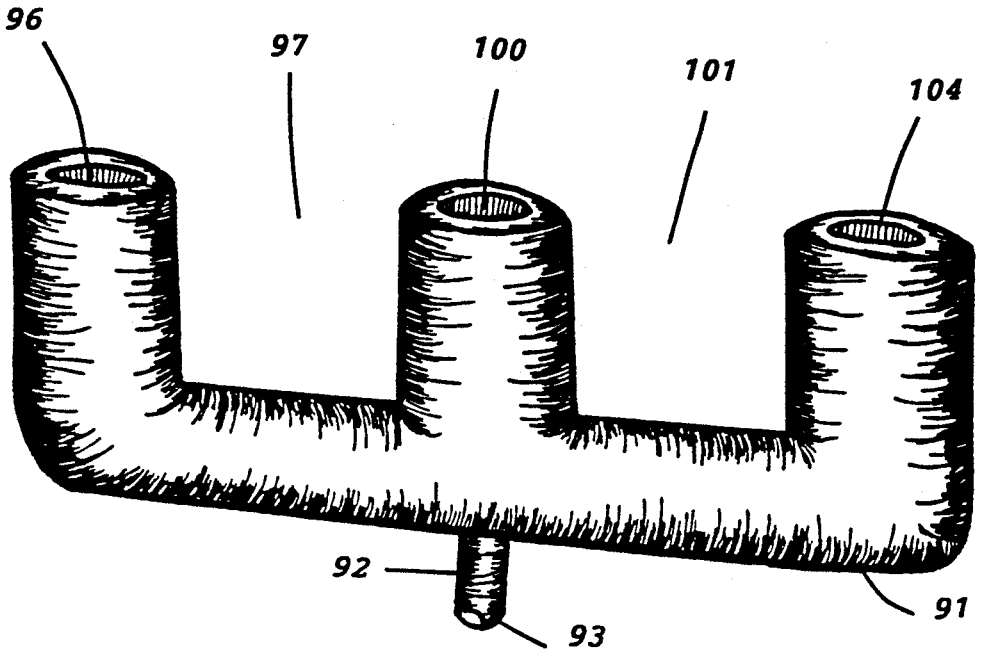
FIGS. 13A and 13B are a cross section and perspective of a removable cylindrical triple top support respectively.
Figure 13A:
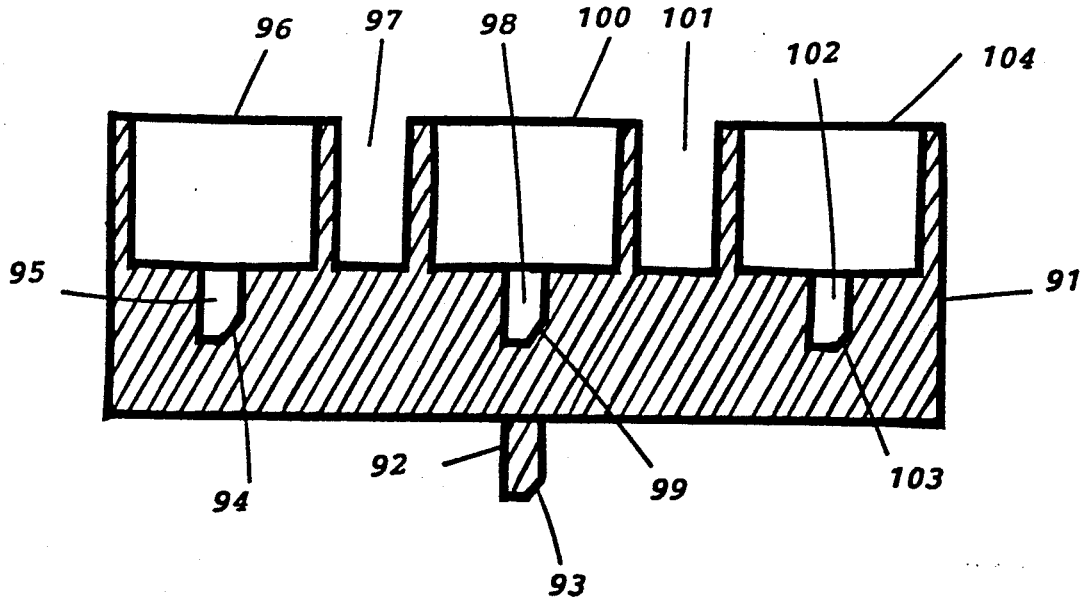

To make the pedestal display more flexible and cost effective, we have designed another useful top support for the system. FIG. 11B shows a simple top 71 which could be used for example to support candles or any other round stick that needs to be held by a pedestal base. Opening 74 will be wide enough to handle for example big candles used at churches. To connect top 71 with the rest of the pedestal display we use the male connector 72, and rotated until lock with 73 on a female connector. If a smaller circumference is needed (for a smaller candle for example) then a reduction holder 80 can be used (see FIG. 11D). Opening 79 will provide support for objects with smaller circumference. The reduction holder is used by connecting it to the pedestal display through its male connector 78, and rotating it until lock with 77 on a female connector. One way of using the reduction holder is to put it inside top 71 by inserting male 78 inside female 75 and rotating until face 77 is locked with face 71. Other tops that can be used with round objects are top 81 in FIG. 12B, and top 91 in FIG. 13B. They are both attached to a pedestal display using their respective male connectors, also they will accept reduction holders. Top 81 in FIG. 12B will support two round objects, and top 91 in FIG. 13B will support three round objects.

Figure 14:
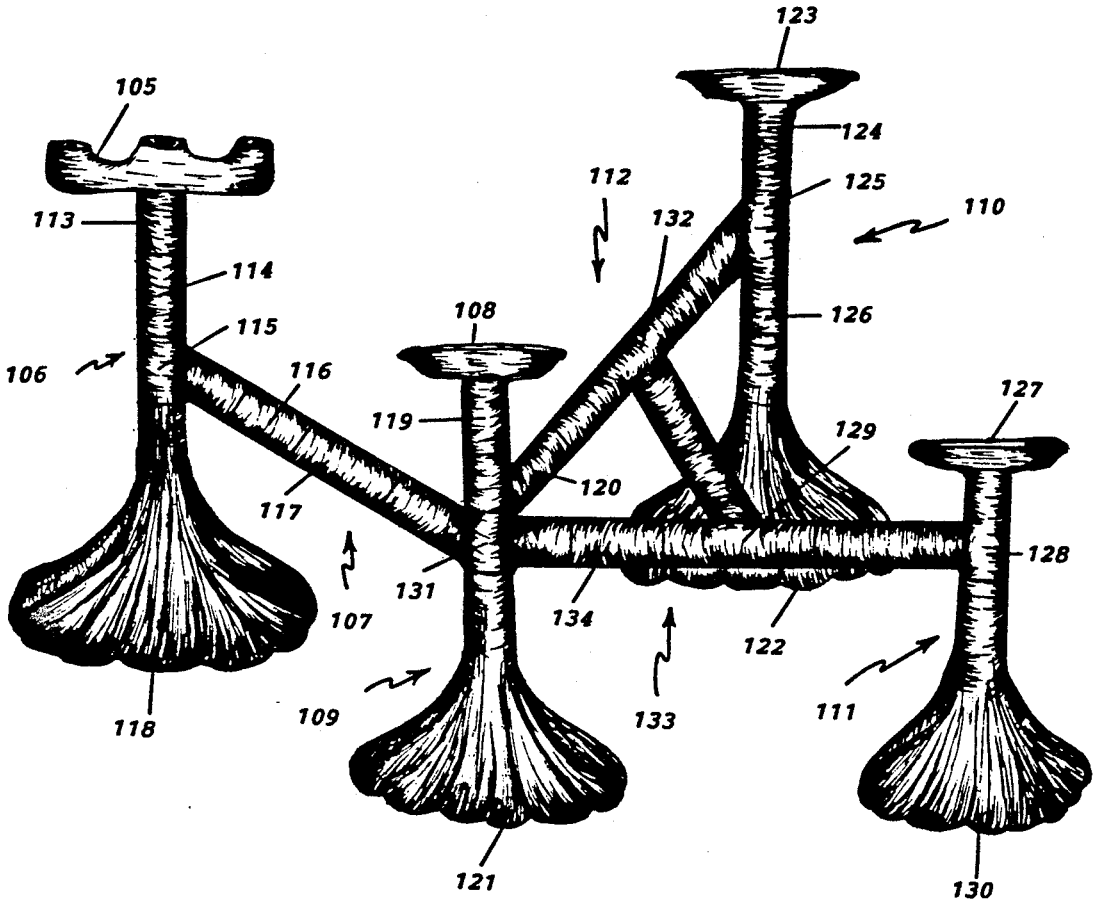
FIG. 14 is a perspective of a pedestal display system.

FIG. 14 shows a perspective of a possible embodiment of a pedestal display system. The pedestal display system in FIG. 14 is comprised of four pedestal display structures 106, 109, 110, and 111, and three link structures 107, 112, and 133. Pedestal display structure 106 was assembled by attaching to the upper end of base 118 a connector 115 which extends upwardly and sideways, with the upper end attaching to extension 114, which itself attaches on its upper end to extension 113, and the upper end of said extension attached to receptacle 105. Pedestal display structure 109 was assembled by attaching to base 121 in its upper end connector 131 which extends upwardly and sideways, the upper end of said connector was attached to connector 120 which extends upwardly and sideways, the upper end of said connector attached to extension 119 and the upper end of said extension was attached to receptacle 108. Pedestal display structure 110 was assembled by attaching to base 122 in its upper end extension 126 which extends upwardly an attaches in its upper end to connector 125 which extends upwardly and sideways, the upper end of said connector attached to extension 124 and the upper end of said extension was attached to receptacle 123. Pedestal display structure 111 was assembled by attaching to base 130 in its upper end connector 128 which extends upwardly and sideways, the upper end of said connector attached to receptacle 127. Link structure 107 was assembled by attaching to one end of base to base connector 117 extension 116. Link structure 112 consists of only base to base connector 132. Link structure 133 was assembled by attaching to one end of base to base connector 129 extension 134. The Pedestal display system of FIG. 14 was assembled by attaching to the sideways extension of connector 115 in pedestal display structure 106 the open end of extension 116 of link structure 107, and attaching base to base connector 117 of link structure 107 to one of the sideways extensions emanating from connector 131 of pedestal display structure 109, and the other sideways extension of connector 131 to open end of extension 134 of link structure 133, and attaching one open end of base to base connector 129 of link structure 133 to the sideways extension of connector 128 of pedestal display 111, then attach the other open end of said base to base connector 129 of link structure 133 to one open end of base to base connector 132 of link structure 112, then attach another open end of said base to base connector 132 to the sideways extension of connector 125 of pedestal structure 110, finally attach the open end of base to base connector 132 of link structure 112 to the sideways extension emanating from connector 120 of pedestal structure 109.

The disclosure of the invention described hereinabove represents the preferred embodiments of the invention; however, variations thereof, in the form, construction, and arrangement of the various components thereof and the modified application of the invention are possible without departing from the spirit and scope of the appended claims.

I claim:

1. A pedestal display comprising a base with an elongate extension rising therefrom, said base having upper and lower ends, a removable support weight attachable to said lower end of said base, and a removable receptacle attachable to the upper end of said base, said base, support, and receptacle sections being joinable to adjacent sections by respective pins and sockets, said pins having obliquely angled end portions, said sockets having obliquely angled socket bottom portions, such that upon the insertion of a pin into a socket, the two oblique portion meet face-to-face to rotationally lock the adjacent sections together.

2. A pedestal display as in claim 1, further comprising at least one removable vertical extension attachable between said base and said receptacle.

3. A pedestal display system comprising two or more pedestal display structures, each of said structures having atop and a bottom, each of said structures comprising a base with an elongate extension rising therefrom, said base having upper and lower ends, a removable support weight attachable to said lower end of said base, a removable receptacle disposed at the top of said structure, at least one removable connecting element attachable to said structure between said receptacle and said base, said connecting element having a vertical portion and a sideways portion, said pedestal display system further comprising at least one pedestal-to-pedestal linking element, said linking element having a center and two or more rods radiating therefrom, each of said rods having a distal end, each of said rod distal ends being attachable to one of said sideways portions of the connecting elements or attachable to another of said at least one pedestal-to-pedestal linking elements.

4. A pedestal display system as in claim 3 wherein at least one of said radiating rods has at least one removable sideways extension.

5. A pedestal display system as in claim 3, wherein each pedestal display structure further comprises at least one removable vertical extension attachable between said receptacle and said base.

6. A pedestal display system as in claim 5, wherein at least one of said radiating rods has at least one removable sideways extension.

* * * * *